United States Patent [19]

Kebe

[11] Patent Number: 4,484,402

[45] Date of Patent: Nov. 27, 1984

[54] CALENDAR

[76] Inventor: Taib Kebe, Banque Centrale des Etats, de l'Afrique de l'Ouest B.P. 3159, Dakar, Senegal

[21] Appl. No.: 481,985

[22] Filed: Apr. 4, 1983

Related U.S. Application Data

[63] Continuation-in-part of Ser. No. 365,914, Apr. 6, 1982, Pat. No. 4,381,614.

[51] Int. Cl.[3] ..... G09D 3/00

[52] U.S. Cl. ..... 40/107; 40/109

[58] Field of Search ..... 40/117, 118, 114, 112, 40/107

[56] References Cited

U.S. PATENT DOCUMENTS

| | | | |
|---|---|---|---|
| 1,670,316 | 5/1928 | Schlusing | 40/117 |
| 1,762,753 | 6/1930 | Aronson | 40/118 |
| 2,029,843 | 2/1935 | Toppin | 40/118 |
| 3,316,668 | 5/1967 | Rogers | 40/117 |
| 4,216,596 | 8/1980 | Brown | 40/118 |
| 4,381,614 | 5/1983 | Kebe | 40/118 |

*Primary Examiner*—Gene Mancene
*Assistant Examiner*—Wenceslao J. Contreras
*Attorney, Agent, or Firm*—B. P. Fishburne, Jr.

[57] ABSTRACT

A perpetual calendar possessing the ability to display any date, past, present or future, in a finite range, and the day of the week for that particular date without prior knowledge or calculation, includes individually gear driven indicia belts for composing month and year dates and another indicia belt which is simultaneously gear driven with the movement of any one of the aforesaid indicia belts. A single drive gear for the aforesaid individually gear driven indicia belts is shiftable into driving engagement with a selected indicia belt by linear movement of a sliding indicator on the top panel of the calendar housing. The drive shaft for the single shiftable drive gear is turned by an external knob on one side of the calendar housing.

6 Claims, 6 Drawing Figures

CALENDAR

CROSS-REFERENCE TO RELATED APPLICATION

This application is a continuation-in-part of copending application Ser. No. 365,914, filed Apr. 6, 1982, for Calendar, now U.S. Pat. No. 4,381,614.

BACKGROUND OF THE INVENTION

This invention relates to improvements in perpetual calendars of the type disclosed in the above patent application. The principle of operation of the calendar according to this invention remains essentially unchanged from that of the calendar in the prior application, although the improved calendar possesses some utility beyond that of the calendar in the prior application.

According to the present invention, the perpetual calendar is operationally much more efficient, it is more convenient to operate, more trouble-free, and a great deal more practical to manufacture on a production basis at reasonable cost. The improved calendar has no parts likely to become separated from the calendar housing and lost during use. The calendar according to the present invention is well adapted to serve as a desk calendar, a wall calendar or even a pocket-size calendar. It can be constructed in a variety of shapes.

Other features and advantages of the invention will become apparent during the course of the following detailed description.

DETAILED DESCRIPTION

Figure 1:
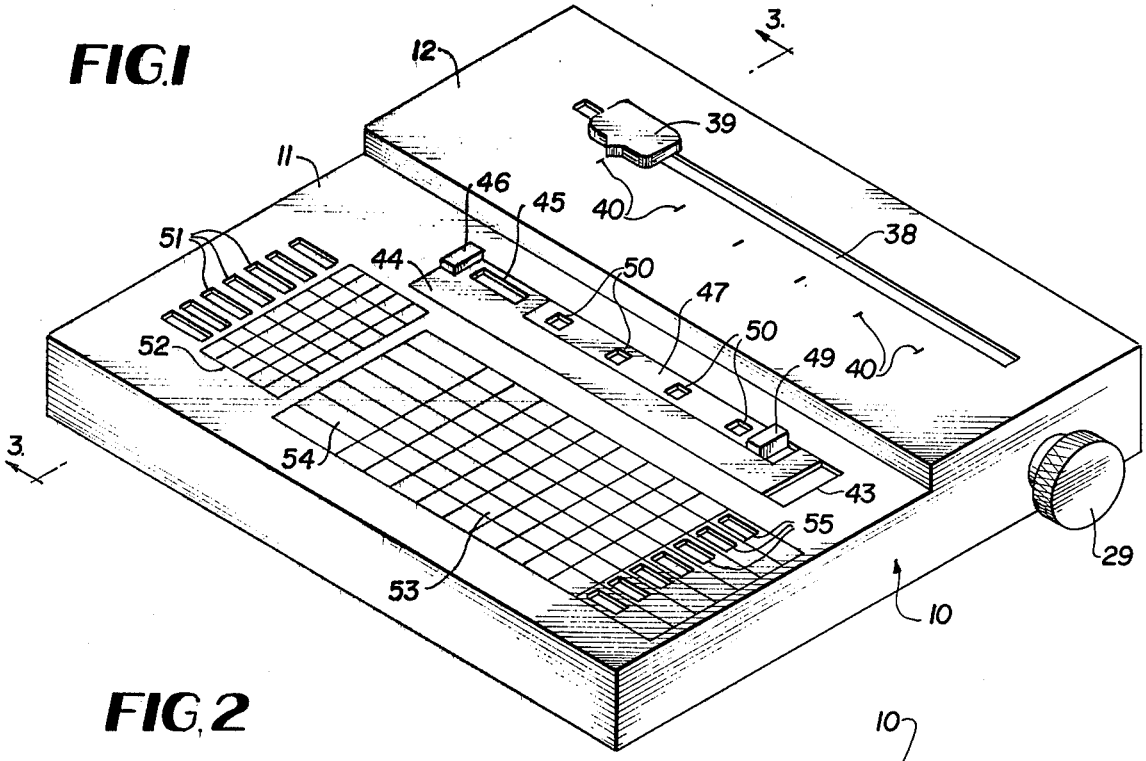
FIG. 1 is a perspective view of a calendar according to the present invention.

Referring to the drawings in detail wherein like numerals designate like parts, a calendar according to a preferred embodiment of the invention comprises a relatively shallow rectangular housing 10 formed of any suitable material. The top of this housing includes an indicia panel 11 and a slightly elevated indicator panel 12.

Within the housing 10 below and closely spaced from the panel 11 are endless belts 13, 14, 15 and 16 carrying year date indicia in exactly the manner described and shown in the prior referenced patent. By means of these four parallel endless belts, the perpetual calendar can display any year date over a finite range, such as year (1) to (9999). Another parallel endless belt 17 carries month designations 18 and 19 in two longitudinal rows exactly as specified in the prior patent. Another belt 20 near one side of the housing 10 and spaced substantially from the belt 17 carries weekday indicia 21 arranged in the manner described in said prior patent.

One additional belt 22, not found in the prior patent, and parallel to the other belts, carries equidistantly spaced indicia marks 23 thereon for a purpose to be described.

Figure 3:
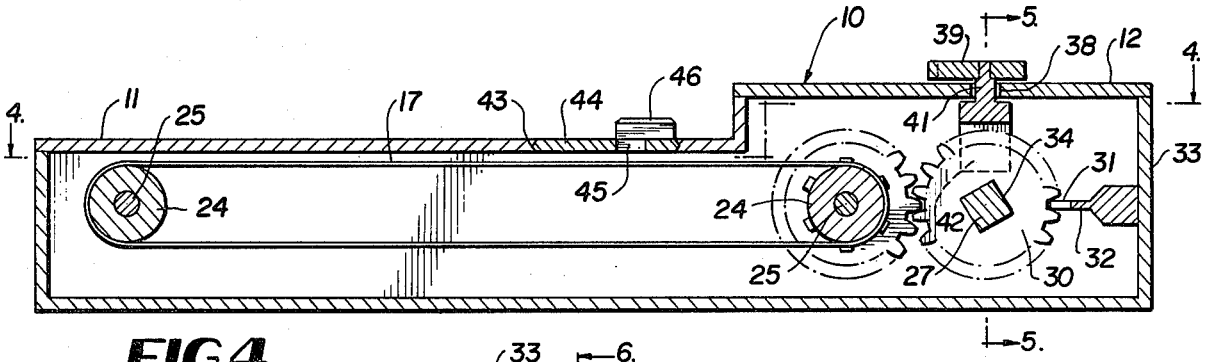
FIG. 3 is a vertical section taken on line 3—3 of FIG. 1.
Figure 4:
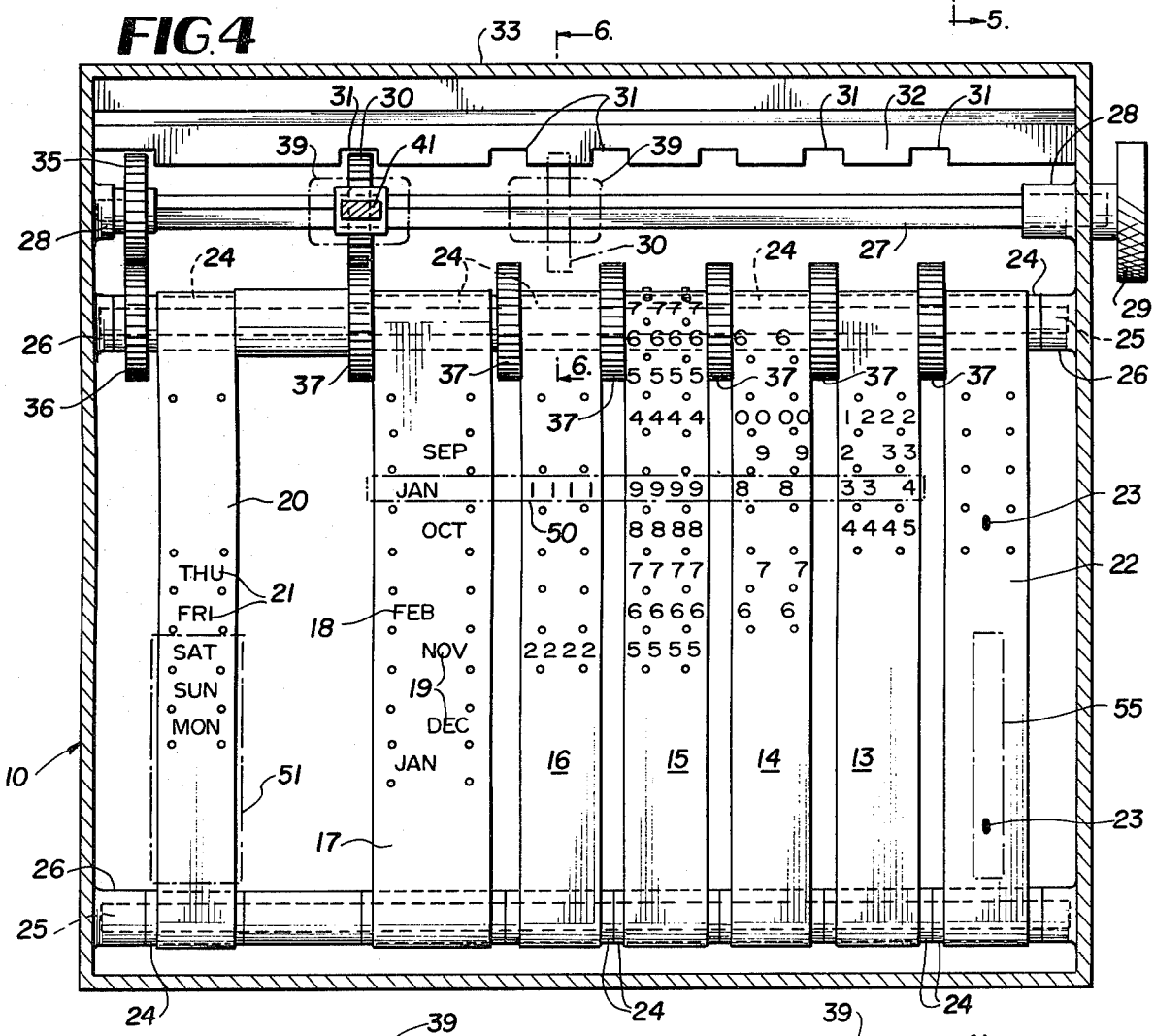
FIG. 4 is a horizontal section taken on line 4—4 of FIG. 3.
Figure 5:
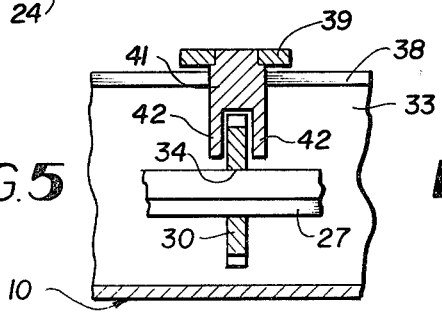
FIG. 5 is a fragmentary vertical section taken on line 5—5 of FIG. 3.

All of the described parallel belts which are maintained taut in the assembled device engage at their opposite ends sleeve rollers 24 which are rotatably held on two parallel support shafts 25, held in bearings 26 on the two side walls of the housing 10. As shown in FIG. 3, one of the shafts 25 is beneath the panel 12.

Near and parallel to this shaft is a preferably square drive shaft 27 also held in bearings 28 on the housing side walls. The drive shaft 27 is manually turned by a knob 29 exteriorly of one housing side wall. The square drive shaft 27 carries a single longitudinally shiftable drive gear 30 which can be shifted axially of the shaft 27 to a plurality of driving positions in the housing 10, such positions being defined by spaced notches 31 formed in a thin blade member 32 fixed to the rear wall 33 of housing 10. The gear 30 has a square opening 34 slidably receiving the shaft 27.

Figure 6:
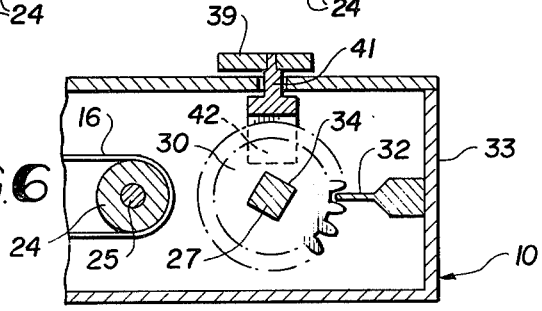
FIG. 6 is a fragmentary vertical section taken on line 6—6 of FIG. 4.

As will be seen, the gear 30 is shifted along the shaft 27 to the driving positions defined by the notches 31 to selectively operate any one of the six belts 13, 14, 15, 16, 17 and 22. A second gear 35 in a fixed location on the drive shaft 27 near one end thereof, and being non-shiftable, is in constant mesh with a gear 36 fixed on the roller 24 of weekday indicia belt 20. Similar gears 37 of equal sizes are similarly fixed on the other sleeve rollers 24 of the shaft 25 which is adjacent to the shaft 27. These gears are not shiftable axially. When driven by the shiftable gear 30, the gears 37 selectively drive their associated belts individually or independently. As best shown in FIG. 6, the gear 30 can be shifted in either direction on the square shaft 27 by rotationally adjusting the gear until the fixed blade 32 is between any two teeth of the gear 30, whereby the gear can be moved axially into one of the positioning notches 31 where the gear teeth are free to rotate as shown in FIG. 3.

In all operating positions along the shaft 27, the gear 30 is rotationally driven by means of the knob 29. Simultaneously, the gears 35 and 36 and the belt 20 will always be driven with any selected one of the belts 13 through 17 and 22.

Directly above the shaft 27, the elevated panel 12 has a long slot 38 across the several gears 37 and their belts. A sliding indicator 39 rides above the panel 12 and can be positioned at cooperative markings 40 in spaced relationship along the slot 38 corresponding to the locations of the gears 37. The indicator 39 is attached to a stem 41 which is guided by the slot 38 in its movement. This stem has depending spaced lug plates 42 which straddle the drive gear 30, as best shown in FIG. 3, so that movement of the indicator 39 will cause shifting of the drive gear 30 along the square shaft 27.

The indicia panel 11 has a guideway 43 parallel to the slot 38 and at right angles to the several indicia belts of the calendar. A first slide 44 having a month display window 45 and an operating knob 46 is shiftable in the guideway 43 so that either of the two rows of month designations 18 and 19 can be displayed through the window 45, exactly as described in the referenced patent. A second slide 47 contained in the guideway 48 of the first slide 44 includes a shifting knob 49 and year date display windows 50. The purpose of the slide 47 is exactly in accordance with the prior referenced patent for displaying odd or even decade numbers in the use of the calendar and this description need not be repeated herein.

Also, as disclosed in said prior patent, the panel 11 has weekday indicia display windows 51 formed therethrough in equidistantly spaced relationship through which the indicia 21 on belt 20 is viewed. Adjacent to the windows 51 is a stationary table 52 having arranged thereon rows and columns of the numeric dates of a thirty-one day calendar month. The use of this table in conjunction with the movable weekday indicia is fully described in the prior patent.

The panel 11 also carries another table 53 thereon not found in the prior patent containing rows and columns of year dates and an adjacent column 54 of month dates by means of which it can be determined exactly when a particular weekday designation for a particular date indicated by the calendar will recur.

Figure 2:
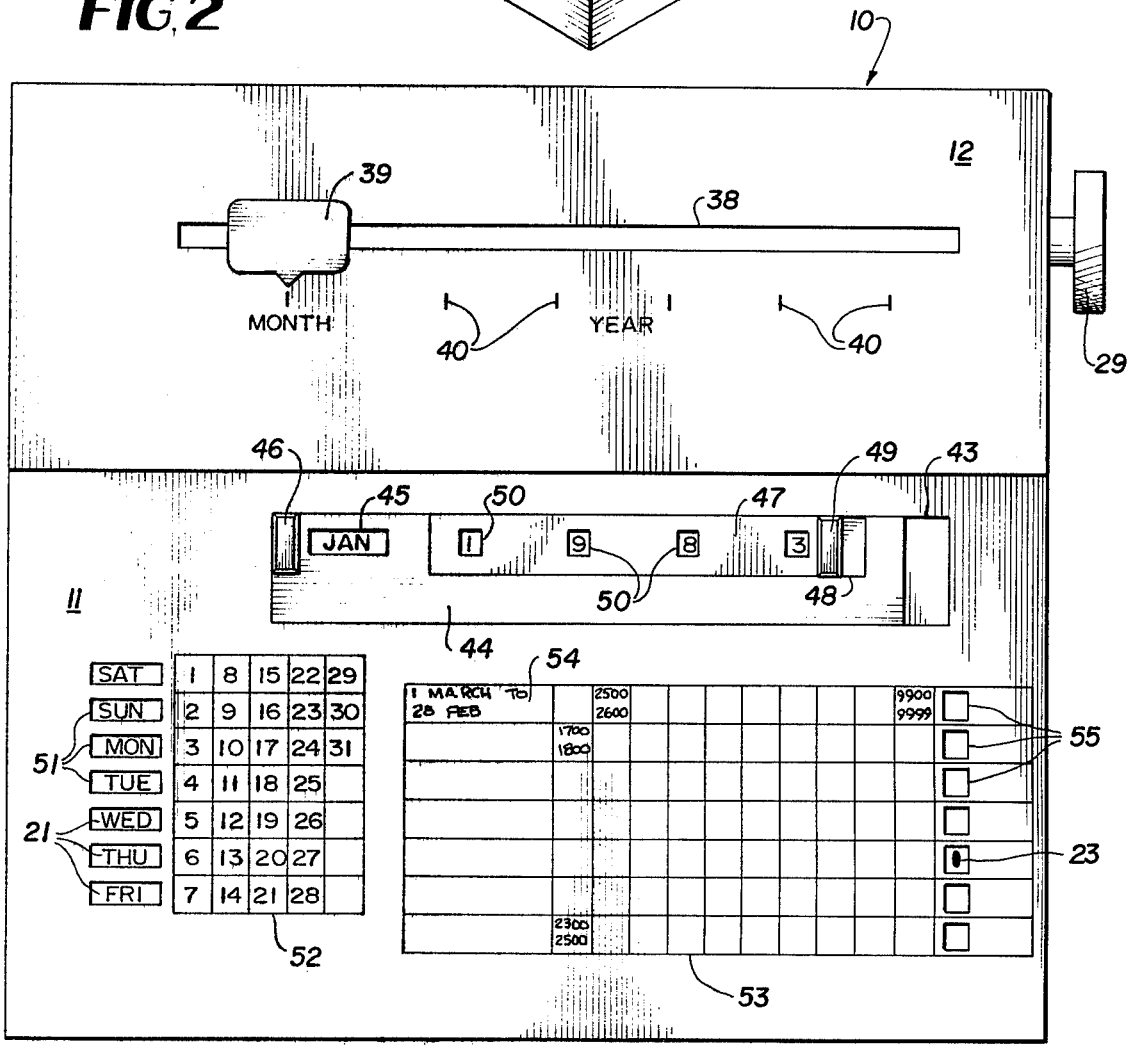
FIG. 2 is an enlarged plan view thereof.

To facilitate the use of the table 53, a column of viewing windows 55 is formed through the panel 11 above the belt 22 having the spaced markings 23. When any given calendar date including weekday designation is dialed into the calendar, such as the date shown in FIG. 2, one of the markings 23 of belt 22 will become aligned with a row of year dates on the table 53 containing the exact year dates in the period of Mar. 1st to Feb. 28th when the same weekday now displayed by the calendar will recur. This information is automatically brought forth by the calendar when the gear 30 is shifted into driving engagement with the gear 37 of belt 22. In all other respects, the use of the calendar herein is exactly as described in the referenced patent and need not be repeated. The heart of the present invention resides in the improved operating structure of the calendar now fully described.

The calendar herein is useful for any past date since the beginning of the leap year system and for any other date in the future until 9999.

The capacity of the calendar has an exponential increase in accordance with the number of annual figures. For this reason, it is possible to change from the Gregorian calendar to the Julian calendar.

The calendar in addition to its uses above-described can be used in a monthly version. In that manner, the seven consecutive weekdays 21 move relative to the fixed month date numbers in the table 52, whenever one changes an element of the date being displayed. Thus, by posting a month and a year, the weekday corresponding to the first day of the month appears automatically in front of day (1) of the month, and in this manner a user obtains the correct posting of the corresponding month. It is not necessary to know the first day of the month in advance, as it is with all prior perpetual calendars.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A calendar comprising a body portion having a display area, plural independently operable webs on the body portion carrying year and month date indicia, another web on the body portion and being movable and carrying weekday indicia, spaced parallel rotary shaft means connected with all of said webs, drive gears individual to the webs carrying the year and month date indicia and operable to drive such webs independently and selectively, another drive gear for the web having said weekday indicia, a drive shaft spaced from and parallel to the axis of said gears, said gears being coaxial, the drive shaft having at least a flat face along its length adjacent to said gears, a single shiftable gear on the drive shaft and being manually movable therealong for selective driving engagement with the gears individual to the webs carrying the year and month date indicia, another non-shiftable drive gear on the drive shaft turning therewith and being in mesh with the gear for driving the web having the weekday indicia thereon, such web being driven whenever the drive shaft is turned with the shiftable gear to drive any one of the webs having the year and month date indicia thereon, means to turn the drive shaft, all of said webs comprising endless belt webs engaged with said parallel rotary shaft means, and the first-named drive gears and said another drive gear being on one shaft of said spaced parallel rotary shaft means and being drivingly connected with their respective webs.

2. A calendar as defined in claim 1, and said drive shaft comprising a shaft which is polygonal in cross section, said single shiftable gear having a mating polygonal drive shaft opening, and an indicator slide element on the body portion connected with the single shiftable gear to shift the latter selectively into driving engagement with any one of the first-named drive gears or said another drive gear.

3. A calendar comprising a body portion having a display area, plural independently operable webs on the body portion carrying year and month date indicia, another web on the body portion and being movable and carrying weekday indicia, spaced parallel rotary shaft means connected with all of said webs, drive gears individual to the webs carrying the year and month date indicia and operable to drive such webs independently and selectively, another drive gear for the web having said weekday indicia, a drive shaft spaced from and parallel to the axis of said gears, said gears being coaxial, the drive shaft having at least a flat face along its length adjacent to said gears, a single shiftable gear on the drive shaft and being manually movable therealong for selective driving engagement with the gears individual to the webs carrying the year and month date indicia, another non-shiftable drive gear on the drive shaft turning therewith and being in mesh with the gear for driving the web having the weekday indicia thereon, such web being driven whenever the drive shaft is turned with the shiftable gear to drive any one of the webs having the year and month date indicia thereon, means to turn the drive shaft, means on the body portion to position the shiftable gear releasably in driving alignment with any one of the first-named drive gears or said another gear, the last-named means comprising a thin blade-like element fixed on the body portion in spaced parallel relationship to said drive shaft and having spaced shiftable gear positioning notches formed therein in alignment with the first-named drive gears and said another gear, and the blade-like element being adapted to engage between adjacent teeth of the shiftable gear to permit shifting of the shiftable gear on the drive shaft to and from selected ones of said notches.

4. A calendar comprising a body portion having a display area, plural independently operable webs on the body portion carrying year and month date indicia, another web on the body portion and being movable and carrying weekday indicia, spaced parallel rotary shaft means connected with all of said webs, drive gears individual to the webs carrying the year and month date indicia and operable to drive such webs independently and selectively, another drive gear for the web having said weekday indicia, a drive shaft spaced from and parallel to the axis of said gears, said gears being coaxial, the drive shaft having at least a flat face along its length adjacent to said gears, a single shiftable gear on the drive shaft and being manually movable therealong for selective driving engagement with the gears individual to the webs carrying the year and month date indicia, another non-shiftable drive gear on the drive shaft turning therewith and being in mesh with the gear for driving the web having the weekday indicia thereon, such web being driven whenever the drive shaft is turned with the shiftable gear to drive any one of the webs having the year and month date indicia thereon, means to turn the drive shaft, and the last-named means comprising a turning knob on one end of the drive shaft exteriorly of the body portion.

5. A calendar as defined in claim 4, and the body portion comprising a shallow housing for all of said webs, spaced parallel rotary shaft means, gears and drive shaft, and said housing having a display panel provided with viewing apertures for the year and month date indicia and weekday indicia of said webs, and the display panel also having a fixed table of numeric month days of a thirty-one day month adjacent to the viewing apertures for the weekday indicia.

6. A calendar as defined in claim 5, and the display panel having another fixed table of year dates arranged in rows and columns and having a column of viewing windows with one window adjacent to each row of year dates in the last-named fixed table, and another movable web connected with said spaced parallel rotary shaft means and having longitudinally equally spaced markings thereon adapted to be viewed through said windows, a drive gear for the last-named web on said shaft means and being coaxial with the other gears thereon and being adapted for engagement with said shiftable gear on said drive shaft to be driven thereby.

* * * * *